US005156133A

United States Patent [19]

Sugimoto et al.

[11] Patent Number: 5,156,133

[45] Date of Patent: Oct. 20, 1992

[54] FUEL SUPPLY DEVICE OF AN ENGINE

[75] Inventors: Tomojiro Sugimoto; Keiso Takeda, both of Shizuoka, Japan

[73] Assignee: Toyota Jidosha Kabushiki Kaisha, Toyota, Japan

[21] Appl. No.: 855,571

[22] Filed: Mar. 23, 1992

[30] Foreign Application Priority Data

Mar. 27, 1991 [JP] Japan ..... 3-63086

[51] Int. Cl.[5] ..... F02M 39/00

[52] U.S. Cl. ..... 123/533; 123/531; 123/585

[58] Field of Search ..... 123/585, 587, 531, 532, 123/533, 534

[56] References Cited

U.S. PATENT DOCUMENTS

| | | | |
|---|---|---|---|
| 1,118,437 | 11/1914 | Muller | 123/533 |
| 4,321,900 | 3/1982 | Takeda | 123/585 |
| 4,387,695 | 6/1983 | Hoppel et al. | 123/531 |
| 4,465,050 | 8/1984 | Igashira et al. | 123/585 |
| 5,024,201 | 6/1991 | Kobayashi et al. | 123/531 |
| 5,046,472 | 9/1991 | Linder | 123/533 |

FOREIGN PATENT DOCUMENTS

| | | |
|---|---|---|
| 58-173767 | 11/1983 | Japan . |
| 61-112773 | 5/1986 | Japan . |
| 63-29055 | 2/1988 | Japan . |

*Primary Examiner*—E. Rollins Cross
*Assistant Examiner*—M. Macy
*Attorney, Agent, or Firm*—Kenyon & Kenyon

[57] ABSTRACT

A fuel supply device comprising a plurality of air assist type fuel injectors each having a nozzle opening, an assist air passage connected to the nozzle opening, and a fuel valve for injecting fuel into the assist air passage. The assist air passages of all of the fuel injectors are connected to a common air manifold via corresponding assist air supply control valves. The air manifold is connected to a fuel pressure regulator for controlling the pressure of fuel fed into the fuel valves. This pressure of fuel is maintained at a pressure higher than the pressure of air in the air manifold, by a fixed pressure, by the fuel pressure regulator.

11 Claims, 2 Drawing Sheets

FUEL SUPPLY DEVICE OF AN ENGINE

BACKGROUND OF THE INVENTION

1. Field of the Invention

The present invention relates to a fuel supply device of an engine.

2. Description of the Related Art

In a known engine, the engine is provided with an assist air type fuel injector comprising a nozzle opening, an assist air passage connected to the nozzle opening, and a fuel valve for injecting fuel into the air assist passage. The assist air passage is connected, via an assist air supply control valve, to the intake passage at a point upstream of the throttle valve. The air pressure in the air assist passage and the vacuum in the intake passage downstream of the throttle valve are made to act on the fuel pressure regulator, to thereby regulate the pressure of fuel fed to the fuel valve. Namely, the pressure of fuel fed to the fuel valve is maintained at a pressure higher than the combined pressure of the air pressure and the vacuum by a fixed pressure, by the fuel pressure regulator (see Japanese Unexamined Utility Model publication No. 58-173767). In this engine, the amount of air fed to the assist air passage is controlled by controlling the opening operation of the assist air supply control valve.

In this engine, however, when the assist air supply control valve is opened or closed, pressure fluctuations are generated in the assist air passage downstream of the assist air supply control valve. At this time, the fluctuations of the pressure are transmitted to the fuel pressure regulator, and thus fluctuations occur in the above-mentioned combined pressure of the air pressure and the vacuum. As a result, fluctuations occur in the pressure of fuel fed to the fuel valve and thus a problem arises in that the amount of fuel injected from the fuel injector fluctuates relative to the regular amount, shortly after the assist air supply control valve is opened or closed.

SUMMARY OF THE INVENTION

An object of the present invention is to provide a fuel supply device capable of preventing fluctuations in the amount of injected fuel relative to the regular amount thereof.

According to the present invention, there is provided a fuel supply device of an engine having an intake passage; the device comprising: a plurality of air assist type fuel injectors each having a nozzle opening to the intake passage, an assist air passage connected to the nozzle opening, and a fuel valve for injecting fuel into the assist air passage; an air manifold common to all the fuel injectors and filled with pressurized air; a plurality of assist air supply control valves each arranged between the air manifold and the assist air passage of the corresponding fuel injector; and a fuel pressure regulator operative in response to a pressure of air in the air manifold and a pressure of fuel fed into the fuel valves, to maintain the pressure of fuel at a pressure higher than the pressure of the air, by a fixed pressure.

The present invention may be more fully understood from the description of a preferred embodiment of the invention set forth below, together with the accompanying drawings

DESCRIPTION OF A PREFERRED EMBODIMENT

Figure 2:
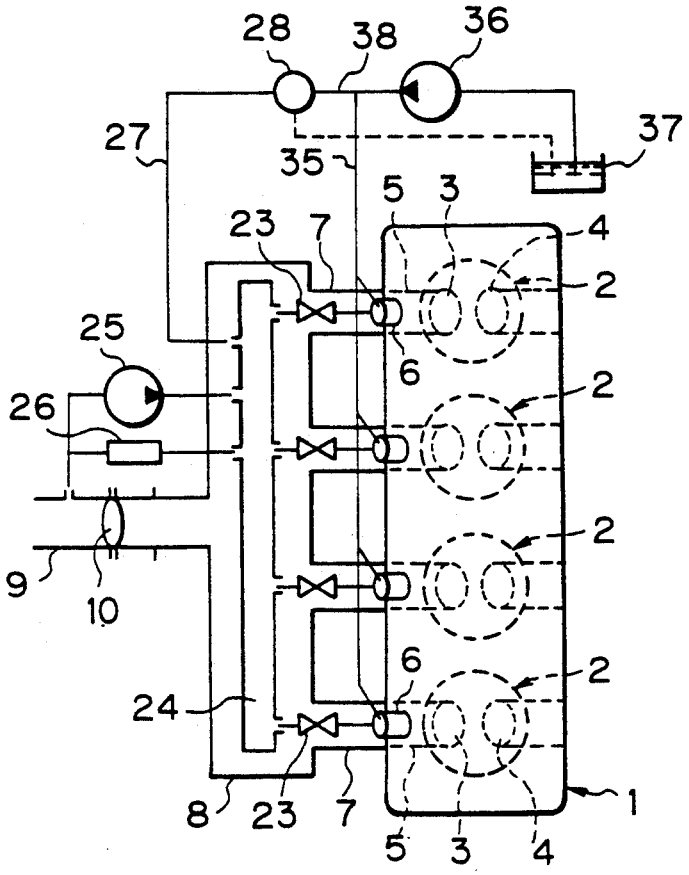
FIG. 2 is a schematically illustrated plan view of an engine.

Referring to FIG. 2, reference numeral 1 designates an engine body, 2 cylinders, 3 intake valves, and 4 exhaust valves; 5 designate intake ports, and 6 air assist type fuel injectors for injecting fuel into the corresponding intake ports 5. The intake ports 5 are connected to a surge tank 8 via corresponding branch pipes 7, and the surge tank 8 is connected to the air cleaner (not shown) via an intake duct 9. A throttle valve 10 is arranged in the intake duct 9.

Figure 1:
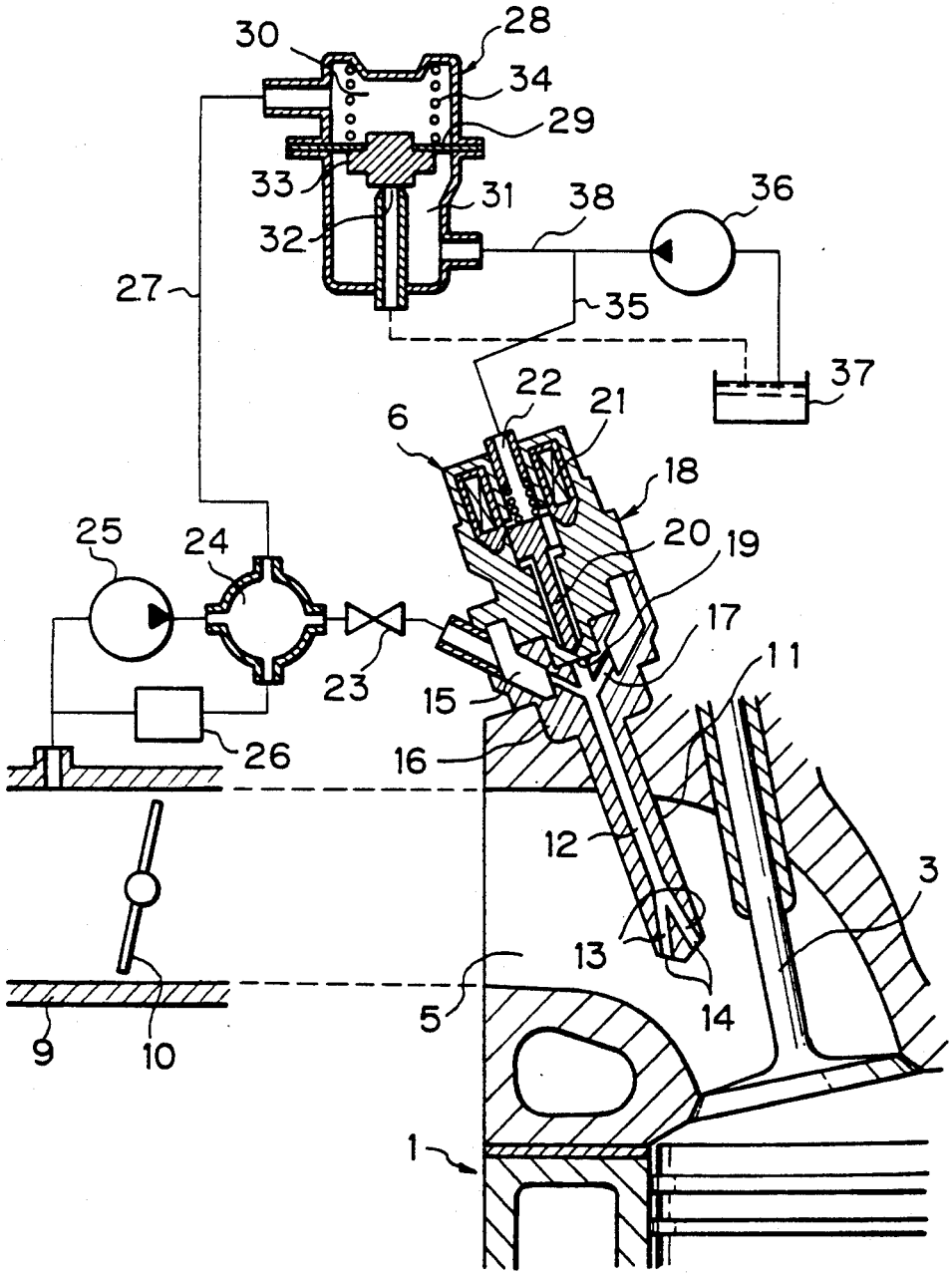
FIG. 1 is a general view of a fuel supply device.

Referring to FIG. 1, the air assist type fuel injector 6 has a nose portion 11 projecting into the intake port 5, and a straight extending fuel air passage 12 is formed in the nose portion 11. A pair of nozzle bores 13 are branched from the lower tip portion of the fuel air passage 12, and nozzle openings 14 are formed at the lower tip portions of the nozzle bores 13. An annular assist air chamber 15 is formed around the upper tip portion of the fuel air passage 12 and connected to the upper tip portion of the fuel air passage 12 via assist air supply bores 16 and 17.

The air assist type fuel injector 6 has a fuel valve 18 therein, the fuel valve 18 comprising a fuel nozzle 19 opening to the deepest interior of the fuel air passage 12, a needle 20 for controlling the opening operation of the fuel nozzle 19, a solenoid 21 for driving the needle 20, and a fuel inlet 22.

As illustrated in FIGS. 1 and 2, the assist air chambers 15 of the fuel injectors 6 are connected, via corresponding assist air supply control valves 23, to an air manifold 24 common to all of the fuel injectors 6. The air manifold 24 is connected, via an air pump 25, to the intake duct 9 upstream of the throttle valve 10, and pressurized air is fed into the air manifold 24 from the air pump 25. Further, a relief valve 26 for returning excess air in the air manifold 24 to the suction side of the air pump 25 is provided for the air manifold 24, and the pressure of air in the air manifold 24 is maintained at a fixed pressure, for example, 2 $kg/cm^2$, by the relief valve 26. Furthermore, the air manifold 24 is connected to a fuel pressure regulator 28 via an air conduit 27.

As illustrated in FIG. 1, the fuel pressure regulator 28 comprises an air chamber 30 and a fuel chamber 31, which are separated by a diaphragm 29, and valve body 33 for controlling the opening operation of the valve port 32 is fixed to the diaphragm 29. The valve body 33 is continuously urged toward the valve port 32 by the spring force of a compression spring 34. The fuel inlet 22 of the fuel injector 18 is connected to a fuel tank 37 via a fuel conduit 35 and a fuel pump 36, and the fuel under pressure discharged from the fuel pump 36 is fed into the fuel inlet 22. The fuel chamber 31 of the fuel pressure regulator 28 is connected to the discharge side of the fuel pump 36 via a fuel conduit 38, and thus the fuel under pressure discharged from the fuel pump 36 is fed into the fuel chamber 31. The pressure of air in the air manifold 24 is introduced to the air chamber 30 of the fuel pressure regulator 28.

When a force of the pressure of fuel in the fuel chamber 31, which causes the diaphragm 29 to move upward, becomes greater than a force of both the pressure of air in the air chamber 30 and the spring force of the compression spring 34, which causes the diaphragm 29 to move downward, the valve body 33 opens the valve port 32. As a result, since fuel in the fuel chamber 31 is returned to the fuel tank 37 via the valve port 32, the pressure of fuel in the fuel chamber 31 drops. Accordingly, the pressure of fuel in the fuel chamber 31 is maintained at a pressure higher than the pressure of air in the air chamber 30, by a fixed pressure determined by the spring force of the compression spring 34. Namely, the pressure of fuel fed into the fuel valve 18 is maintained at a pressure higher than the pressure of air in the air manifold 24, by the fixed pressure.

Figure 3:
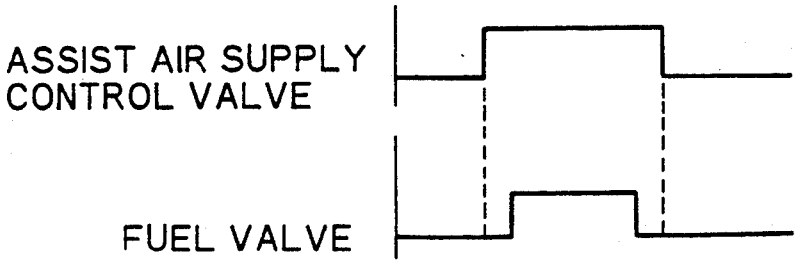
FIG. 3 is a diagram illustrating the opening timings of the assist air supply control valve and the fuel valve.

FIG. 3 illustrates the opening timings of the assist air supply control valve 23 and the corresponding fuel valve 18. As can be seen from FIG. 3, the fuel valve 18 is open for a time during which the assist air supply control valve 23 is open, and in this time, fuel is injected by the fuel valve 18. When the assist air supply control valve 23 opens, the pressurized air in the air manifold 24 is fed into the assist air chamber 15 via the assist air supply control valve 23 and then injected from the nozzle opening 14 into the intake port 5 via the assist air bores 16, 17, the fuel air passage 12 and the nozzle bores 13. Thereafter, when the fuel valve 18 is opened, fuel is injected from the fuel nozzle 19 along the axis of the fuel air passage 12, and thus the pressurized air and fuel are injected from the nozzle openings 14.

The amount of fuel injected by the fuel valve 18 is determined by both the injection time and the pressure difference between the pressure of fuel fed into the fuel valve 18 and the pressure of pressurized air, which acts on the fuel nozzle 19. Accordingly, where the amount of fuel injected by the fuel valve 18 is controlled by controlling the fuel injection time, the pressure difference between the pressure of fuel fed into the fuel valve 18 and the pressure of pressurized air, which acts on the fuel nozzle 19, must be maintained constant to accurately equalize the amount of injected fuel with the regular amount thereof. In the embodiment illustrated in FIGS. 1 and 2, as mentioned above, the pressure difference of the pressure of fuel fed into the fuel valve 18 and the pressure of air in the air manifold 24 is maintained constant by the fuel pressure regulator 28. Accordingly, to accurately equalize the amount of injected fuel with the regular amount thereof, the pressure of pressurized air, which acts on the fuel nozzle 19, must become equal to the pressure of air in the air manifold 24. To this end, as illustrated in FIG. 1, the air manifold 24 is provided, and the fuel air passage 12 is formed so that it has a length considerably longer than that of the assist air bores 16 and 17.

Namely, when the assist air supply control valve 23 is opened, the pressurized air in the air manifold 24 is fed into the assist air chamber 15. At this time, since the air manifold 24 has a considerably large volume, the pressure of pressurized air in the air manifold 24 drops a little and thus the pressure of pressurized air in the assist air chamber 15 becomes substantially equal to the pressure of pressurized air in the air manifold 24. Also, since the length of the assist air supply bores 16 and 17 is considerably shorter than the length of the fuel air passage 12, little pressure drop occurs in the air supply bores 16 and 17, and thus the pressure of the pressurized air, which acts on the fuel nozzle 19, becomes substantially equal to the pressure of the pressurized air in the air manifold 24.

When the assist air supply control valve 23 is opened or closed, fluctuations in the pressure are generated at both the upstream and the downstream side of the assist air supply control valve 23. Nevertheless, since the air manifold 24 has a considerably large volume, the fluctuation of pressure generated at the upstream side of the assist air supply control valve 23 is attenuated in the air manifold 24, and thus the pressure of air in the air chamber 30 of the fuel pressure regulator 23 does not fluctuate and is maintained constant. Accordingly, the amount of fuel injected by the fuel valve 18 also does not fluctuate and thus is maintained at the regular amount thereof. Further, since the assist air chamber 15 has a relatively large volume, the fluctuations of pressure generated at the downstream side of the assist air supply control valve 23 are attenuated in the assist air chamber 15. Accordingly, from this view point also, it is possible to maintain the amount of the injected fuel at the regular amount thereof.

According to the present invention, therefore, it is possible to prevent fluctuations in the amount of fuel injected by the fuel injection, relative to the regular amount thereof.

While the invention has been described by reference to a specific embodiment chosen for purposes of illustration, it should be apparent that numerous modifications could be made thereto by those skilled in the art without departing from the basic concept and scope of the invention.

We claim:

1. A fuel supply device of an engine having an intake passage; said device comprising:

a plurality of assist air type fuel injectors each having a nozzle opening opening to the intake passage, an assist air passage connected to said nozzle opening, and a fuel valve for injecting fuel into said assist air passage;

an air manifold common to all said fuel injectors and filled with pressurized air;

a plurality of assist air supply control valves each arranged between said air manifold and said assist air passage of said corresponding fuel injector; and a fuel pressure regulator operative in response to a pressure of air in said air manifold and a pressure of fuel fed into said fuel valves, to maintain said pressure of fuel at a pressure higher than said pressure of air, by a fixed pressure.

2. A fuel supply device according to claim 1, wherein each of said assist air passages comprises a fuel air passage into which fuel is injected by said fuel valve, an assist air chamber connected to said air manifold via said corresponding assist air supply control valve, and an assist air supply passage connecting said assist air chamber to said fuel air passage and opening to said fuel air passage in the vicinity of said fuel valve, said assist air supply passage having a length shorter than that of said fuel air passage.

3. A fuel supply device according to claim 2, wherein said nozzle opening is formed at one end of said fuel air passage, and said fuel valve is arranged at other end of said fuel air passage, said assist air supply passage opening to said other end of said fuel air passage.

4. A fuel supply device according to claim 2, wherein said fuel air passage extends straight.

5. A fuel supply device according to claim 4, wherein each of said fuel injectors has a nose portion projecting into the intake passage, and said fuel air passage is formed in said nose portion.

6. A fuel supply device according to claim 2, wherein said assist air chamber has an annular shape and extends around said fuel air passage.

7. A fuel supply device according to claim 1, each of said fuel injector has a pair of nozzle openings branched from said assist air passage.

8. A fuel supply device according to claim 1, further comprising an air pump for feeding said pressurized air into said air manifold.

9. A fuel supply device according to claim 1, wherein said fuel valve is open for a time during which said corresponding assist air supply control valve is open.

10. A fuel supply device according to claim 1, further comprising a fuel pump for feeding fuel into said fuel valves of all of said fuel injector, said fuel pressure regulator controlling an amount of fuel fed into said fuel valves from said fuel pump.

11. A fuel supply device according to claim 10, wherein, said fuel pressure regulator comprises a diaphragm, an air chamber formed on one side of said diaphragm and connected to said air manifold, a fuel chamber formed on other side of said diaphragm and connected to a fuel passage between said fuel pump and said fuel valves, and a valve port normally closed by said diaphragm and opening to said fuel chamber when a pressure of fuel in said fuel chamber becomes higher than a pressure of air in said air chamber, by said fixed pressure, to thus discharge fuel from said fuel chamber.

* * * * *

UNITED STATES PATENT AND TRADEMARK OFFICE

CERTIFICATE OF CORRECTION

PATENT NO. : 5,156,133

DATED : October 20, 1992

INVENTOR(S) : Tomojiro SUGIMOTO, et al.

It is certified that error appears in the above-identified patent and that said Letters Patent is hereby corrected as shown below:

ABSTRACT, line 11, delete the comma after "pressure" at the end of the line.

Column 5, line 5, change "has" to --having--.

Column 5, line 15, change "injector," to --injectors,--.

Signed and Sealed this

Sixteenth Day of November, 1993

*Attest:*

*Attesting Officer*

BRUCE LEHMAN

*Commissioner of Patents and Trademarks*